US007690353B2

(12) United States Patent
Shafer et al.

(10) Patent No.: US 7,690,353 B2
(45) Date of Patent: Apr. 6, 2010

(54) SYNCHRONIZING COMMON RAIL PUMPING EVENTS WITH ENGINE OPERATION

(75) Inventors: Scott Shafer, Morton, IL (US); Jianhua Zhang, Dunlap, IL (US); Daniel Ibrahim, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 30 days.

(21) Appl. No.: 11/998,652

(22) Filed: Nov. 30, 2007

(65) Prior Publication Data

US 2009/0139493 A1 Jun. 4, 2009

(51) Int. Cl.
*F02M 37/04* (2006.01)

(52) U.S. Cl. ..... 123/445; 123/446; 123/495

(58) Field of Classification Search ..... 123/445, 123/446, 447, 450, 495
See application file for complete search history.

(56) References Cited

U.S. PATENT DOCUMENTS 5,197,438 A * 3/1993 Kumano et al. ..... 123/506
5,697,343 A * 12/1997 Isozumi et al. ..... 123/446
6,142,125 A 11/2000 Shimayama et al.
6,378,499 B1 4/2002 Shimayama et al.
6,484,696 B2 11/2002 Barnes et al.
6,745,753 B2 * 6/2004 Spinnler et al. ..... 123/509
6,763,808 B2 7/2004 Ryuzaki
6,820,596 B2 * 11/2004 Namari et al. ..... 123/501
6,823,844 B2 * 11/2004 Steinbrenner et al. ..... 123/446
6,843,641 B1 * 1/2005 Scharfenberg ..... 417/273

FOREIGN PATENT DOCUMENTS

DE 31 13 737 A1 10/1982
EP 0299337 1/1989
EP 1219827 7/2002
EP 1350948 10/2003
EP 1674718 6/2006
EP 1990531 11/2008

* cited by examiner

*Primary Examiner*—Thomas N Moulis
(74) *Attorney, Agent, or Firm*—Liell & McNeil; Carl E. Myers

(57) ABSTRACT

Noise and vibrations associated with a common rail fuel system drive linkage are reduced by synchronizing a high pressure common rail supply pump with engine operation. This may be accomplished by selecting a linkage associated with a desired ratio of engine speed to pump speed along with selecting a number of pump plungers and cam lobes that results in synchronizing action of the pump with engine combustion events. In particular, a pattern of pumping events per engine cycle repeats during each engine cycle. In a more sophisticated version, the pattern of pumping events per engine cycle includes a sub-pattern of pumping events that repeats an integer number of times each engine cycle, where the integer number equals the number of engine cylinders.

16 Claims, 5 Drawing Sheets

Alternative Scenarios to Provide Synchronous
High Pressure Pumping and Combustion Events

| Number of Cylinders | Number of Pumps | Pump Drive Ratio | Plungers /Pump | Cam Lobe | Pump Strokes/ Combustion Event |
|---|---|---|---|---|---|
| 20 | 1 | 5:3 | 2 | 3 | 1.00 |
| 20 | 2 | 5:4 | 2 | 2 | 1.00 |
| 16 | 1 | 4:3 | 2 | 3 | 1.00 |
| 16 | 2 | 1:1 | 2 | 2 | 1.00 |
| 12 | 1 | 1:1 | 2 | 3 | 1.00 |
| 8 | 1 | 4:3 | 2 | 3 | 2.00 |
| □ 8 | 1 | 1:1 | 2 | 2 | 1.00 |
| ☆ 6 | 1 | 1:1 | 2 | 3 | 2.00 |
| 5 | 1 | 5:6 | 2 | 3 | 2.00 |
| 5 | 1 | 5:4 | 2 | 2 | 2.00 |
| ☆ 4 | 1 | 1:1 | 2 | 3 | 3.00 |
| 4 | 1 | 1:1 | 2 | 2 | 2.00 |
| ☆ 3 | 1 | 1:1 | 2 | 3 | 4.00 |
| □ 6 | 1 | 1.5:1 | 2 | 2 | 2.00 |

Figure 5

Pump Family Concept

SYNCHRONIZING COMMON RAIL PUMPING EVENTS WITH ENGINE OPERATION

TECHNICAL FIELD

The present disclosure relates generally to common rail fuel systems for internal combustion engines, and more particularly to synchronizing pumping events of a common rail supply pump with engine combustion events.

BACKGROUND

Over the years, common rail fuel systems for compression ignition engines have been gaining acceptance in the industry. A typical common rail fuel system includes a high pressure pump that is driven directly via linkage by the engine crank shaft to supply high pressure fuel to a common rail. Individual fuel injectors are positioned for direct injection of fuel into individual engine cylinders, and each fuel injector is fluidly connected to the common rail via an individual branch passage. The high pressure pump will typically include from one to six reciprocating pump plungers that are each driven by individual or shared cams that include typically from one to six lobes per cam. As the cam rotates, each lobe causes its associated plunger(s) to reciprocate at least once for an individual camshaft rotation. The number of strokes is dependent upon the detailed shape of the camshaft lobe. The lobe can be shaped to provide 1, 2, 3, or more integer numbers of plunger strokes per lobe per camshaft revolution. Although the cam(s) are driven to rotate directly by the engine crank shaft via a linkage, designers can select a linkage to provide any suitable ratio of engine speed to pump speed. The number of pumping events per engine cycle, which corresponds to 720° of rotation for a four cycle engine, can be calculated by multiplying the ratio of the pump speed to engine speed times two, and multiplying that product by the product of the number of pump plungers times the number of cam lobes times the number of plungers strokes per camshaft rotation provided by the camshaft lobe shape.

Almost all common rail fuel systems utilize an electronic controller with a feedback control system to control pressure in the common rail while the engine is operating. The problem of rail pressure control has plagued engineers for many years since the rail pressure has a tendency to fluctuate due to the fact that fuel is leaving the common rail for fuel injection events on an intermittent basis, and fuel is being supplied to the common rail in a less than steady state fashion corresponding to individual sequential pumping events. In many cases, a rail pressure sensor will provide information to the electronic controller that will then compare that sensed pressure to a desired pressure, and determine an error. This error will typically be multiplied by some gain in order to determine an adjustment to the output rate from the high pressure pump to move the sensed common rail pressure closer to the desired pressure. For instance, the controller may command one or more spill valves associated with the high pressure pump to close at particular timings to change the output rate from the pump by displacing only a fraction of the pump plunger's displacement toward the common rail, with the remaining portion of that pump plunger's displacement being recirculated at low pressure. In other systems, pump output is controlled by throttling inlet flow with an electronically controlled valve. These strategies often utilize intensive numerical processing that may or may not include filtering of pressure sensor measurements in the highly dynamic environment of common rail pressure associated with a nearly incompressible liquid (diesel fuel) while pumping and injection events are intermittently occurring.

An improvement on this basic feedback control strategy is described in co-owned U.S. Pat. No. 6,484,696. This system reduces the time lag in correcting the rail pressure via reliance on a model based strategy for anticipating fuel arriving and leaving the common rail so that the feedback controller need only correct errors between the model and the actual amount of fluid arriving and leaving at the common rail. The end result being tighter control and less time lag in removing errors in rail pressure. While these strategies have proven successful in controlling rail pressure, engineers have come to recognize that holding rail pressure steady in the highly dynamic environment of fuel leaving and arriving at different times to the common rail at different rates is very problematic. Those skilled in the art will appreciate that injection rates are generally proportional to rail pressure at the time the fuel injector nozzle opens. Thus, fluctuating rail pressures will inherently lead to some uncertainty in fuel injection rates and amounts, which can degrade both performance, increase undesirable emissions, and cause undesirable noise and vibrations.

One strategy for supposedly decreasing common rail pressure variations is taught in U.S. Pat. No. 6,763,808. This reference teaches the use of asymmetrical cam lobes to reduce drive torque variations, and hence supposedly reduce both pressure variations in the common rail and potentially lead to lower noise in the linkage that connects the pump drive shaft to the engine crank shaft. Noise in the linkage can occur generally due to the cyclic torques occurring in the linkage due to the cam lobes being loaded and unloaded as each pump plunger undergoes its pumping stroke and then passes through its top dead center position. As the industry demands ever higher injection pressures in order to improve performance and decrease undesirable emissions, noise and vibration issues generated in the linkage connecting the engine crank shaft to the high pressure common rail pump drive shaft can become more problematic. These vibrations can lead to early failure in the linkage. In addition, these problems are compounded by the fact that some jurisdictions are now prescribing noise limits for engines that are becoming increasingly hard to satisfy.

Another problem constantly plaguing engine manufacturers is how to leverage pump design for a proven application into a new engine. For instance, those skilled in the art will recognize that newly designing a pump for every different engine in a family of engines from a single manufacturer can be extremely expensive and time consuming. On the other hand, for utilizing technologically proven pumps with little or no modification in a family of different engines could be very cost effective. However, doing this has proven extremely difficult to accomplish in practice. For instance, the same pump used in a six cylinder engine equipped with a common rail fuel system when used in a four cylinder engine may produce excessive noise and vibrations, along with less than ideal rail pressure stability.

The present disclosure is directed toward one or more of the problems set forth above and/or other problems.

SUMMARY OF THE DISCLOSURE

In one aspect, a method of operating an engine includes pressurizing fuel in a common rail to a pressure in excess of about 160 megapascals with at least one pump. Fuel is injected into a plurality of engine cylinders via respective fuel injectors connected to a common rail. The action of the at least one pump is synchronized with the engine such that a pattern of pumping events per engine cycle repeats during each engine cycle.

In another aspect, an engine includes an engine housing with a plurality of cylinders disposed therein. A crank shaft is rotationally supported in the engine housing. A common rail fuel system is attached to the engine housing, and is configured to contain fuel at a pressure in excess of about 160 megapascals. The common rail fuel system includes at least one pump with an outlet fluidly connected to the common rail, and a plurality of fuel injectors with inlets fluidly connected to the common rail. Each of the fuel injectors is positioned for direct injection into one of the plurality of engine cylinders, and the pump includes at least one pump plunger with a cam having a number of lobes associated with each pump plunger. A linkage operably couples the pump to the crank shaft. The linkage, the number of pump plungers, and the number of lobes are configured to produce a pattern of pumping events per engine cycle that repeats each engine cycle.

In another aspect, a family of engines includes a first group of identical x cylinder engines that each include a common rail fuel system with a rail supply pump. A second group of y cylinder engines each include a common rail fuel system with the same rail supply pump. X and Y are different numbers such that the first group has engines having a different number of cylinders than the second group. The rail supply pump is configured in both the X cylinder engines and the Y cylinder engines to produce a pattern of pumping events per engine cycle that repeats each engine cycle.

In still another aspect, a method of designing a new engine includes a step of selecting a common rail fuel system with an operating pressure in excess of 160 megapascals. A common rail supply pump is configured to be driven directly by a crankshaft of the engine to produce a repeating pattern of pumping events in each engine cycle that repeats each engine cycle.

BRIEF DESCRIPTION OF THE DRAWINGS

FIG. 5 is table showing various combinations of engine cylinders and common rail pumps according to the present disclosure.

DETAILED DESCRIPTION

Figure 1:
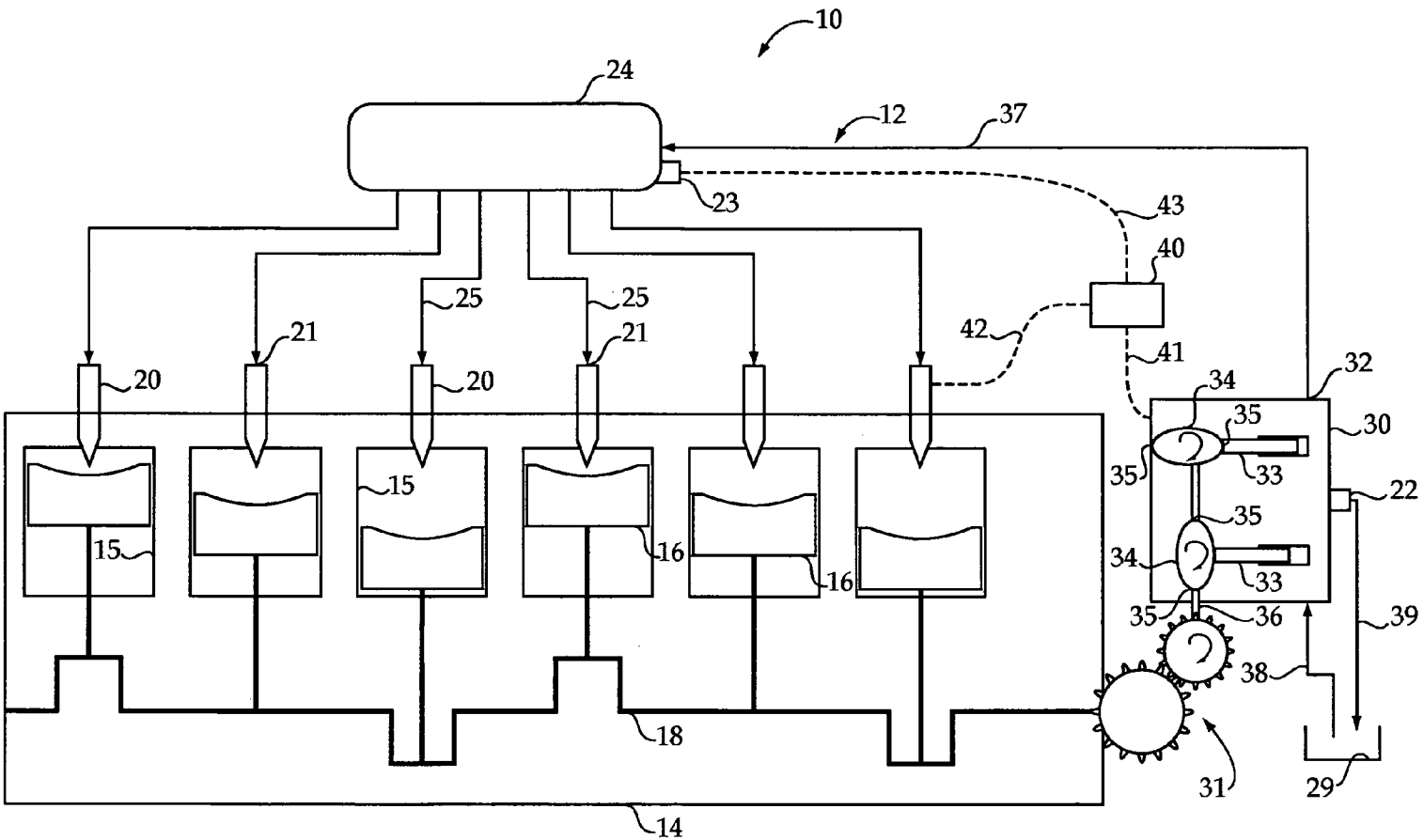
FIG. 1 is a schematic illustration of an engine that includes a common rail fuel system according to one aspect of the present disclosure.

Referring to FIG. 1, an example engine 10 according to the present disclosure includes a common rail fuel system 12 configured to operate at fuel pressures in excess of about 160 megapascals. The term "about" means that when a number is rounded to a number of significant digits, the two numbers are equal. Thus, 159.5 is about equal to 160. In order to operate at pressure in excess of 160 megapascals, various features of the fuel system require increased structural strength and fluid pressure containment capabilities greater than those associated with lower pressure common rail fuel systems. These structural features might include, but are not limited to, double walled fuel lines, high pressure fittings, relatively thick walled common rail and other features known in the art. Engine 10 is like many other engines in that it includes a housing 14 with a plurality of cylinders 15 disposed therein. A piston 16 is positioned to reciprocate in each of the cylinders 15 in a conventional manner to drive rotation of a crank shaft 18. In the illustrated embodiment, engine 10 is shown as an in line six cylinder engine. However, those skilled in the art will appreciate that the concepts of the present disclosure are potentially applicable to engines with any number of cylinders including three cylinder engines up to possibly 20 cylinders and beyond. Engine 10 is a four cycle engine such that each engine cycle results in two revolutions of crank shaft 18 for a total of 720° of rotation. During each engine cycle, each piston 16 will reciprocate twice in its individual cylinder 15 to undergo a compression stroke, a power stroke, and exhaust stroke and an intake stroke.

Common rail fuel system 12 includes a high pressure pump 30 that includes one or more pump plungers 33 driven to reciprocate by one or more cams 34 having one or more lobes 35. In the particular embodiment shown, pump 30 includes two pump plungers 33 each driven to rotate by a cam 34 with two lobes 35. Cams 34 may be mounted to rotate about a common pump shaft 36 that is driven directly by engine crank shaft 18 via a linkage 31, such as a gear train of a type known in the art. "Driven directly" includes being driven by another engine component coupled to engine crankshaft 18, such as a camshaft drive gear or some other accessory drive or idler gear. When operating, pump 30 draws fuel from tank 29 along supply line 38 and delivers high pressure fuel to outlet 32. Pump 30 may be electronically controlled, such as via an inlet metering valve (not shown) that has a flow area controlled by commands from electronic controller 40 via communication line 41. Alternatively, output from pump 30 could be controlled using a spill valve technique known in the art. Regardless of how pump 30 is controlled, each of the pump plungers displaces a fixed quantity of fluid (fuel or fuel and vapor) with each reciprocation, but the control allows for controlling the amount or the fraction of that fuel that is displaced to outlet 32 at high pressure. Pump 30 may also be equipped with a pressure relief valve 22 that is set to open at some desired pressure, to route excess pressure fuel back to tank 29 via return line 39 in order to prevent fuel system 12 from being over pressurized. Those skilled in the art will appreciate that linkage 31 can be chosen to provide any desired rotational speed ratio between crank shaft 18 and pump shaft 36.

Common rail fuel system 12 also includes individual fuel injectors 20 positioned for direct injection of fuel into the individual cylinders 15. Each fuel injector 20 includes an inlet 21 connected to a common rail 24 via an individual branch passage 25. Fuel from the outlet 32 of pump 30 is supplied to common rail 24 via a high pressure line 37 in a conventional manner. Each of the individual fuel injectors 20 may be electronically controlled so that both a quantity and timing of a fuel injection event can be controlled independent of the angle of crank shaft 18 via commands from an electronic controller 40 via an individual communication line 42, only one of which is shown. Depending upon the type of fuel injector 20, they may also include a low pressure return line (not shown) for returning low pressure fuel back to tank 29 for recirculation. For instance, many fuel injectors utilize a fraction of the pressurized fuel from the common rail to perform control functions in a manner well known in the art.

Those skilled in the art will appreciate that because fuel is intermittently leaving common rail 24 for individual fuel injection events and intermittently arriving in common rail 24 via pumping events from pump 30, holding pressure in common rail 24 constant has proven problematic. In order to control pressure in common rail 24, a pressure sensor 23 may be provided for sensing the pressure of fuel in common rail 24 and communicate the same to electronic controller 40 via communication line 43. Electronic controller 40 uses this information, and maybe other information, such as throttle position, etc. to generate commands to pump 30 to displace a precise amount of pressurized fuel from outlet 32 to common rail 24 in an attempt to maintain fluid pressure in the common rail at some desired level. However, the present disclosure recognizes that a better alternative to ever more elaborate attempts to maintain a constant rail pressure is to embrace the fact that by its very nature pressure will fluctuate in common rail 24 even though controller 40 may be able to maintain an average pressure with extremely tight control with an acceptable variance about that average. Nevertheless, those skilled in the art will recognize that the amount of fuel that an individual fuel injector 20 injects, is closely related to the precise pressure in common rail 24 at the moment that the nozzle outlets of the fuel injector 20 open for an injection event. Given this fact, the present disclosure is directed to synchronizing a relation between pumping events from pump 30 with injection events from fuel injectors 20 so that each fuel injector 20 in sequence sees the same rail pressure at the start of its individual injection event. Even more desirable is for each fuel injector to see both the same initial pressure in common rail at the start of an injection event, but also see the same changes rail pressure over the duration of the injection event.

Those skilled in the art will appreciate that if fuel injectors 20 are otherwise identical, they should inject about the same amount of fuel in the same way over the same duration if each fuel injector performs its injection event over an identical looking pressure wave segment of the fluctuating rail pressure in common rail 24. The present disclosure accomplishes this by configuring the pump 30 to produce a repeating pattern of pumping events in each engine cycle that repeats in each engine cycle. Configuring pump 30 is accomplished by selecting a drive speed ratio between crank shaft 18 and pump shaft 36, selecting an appropriate number of pump plungers 33 along with an appropriate number of cam lobes 35 per plunger to produce an identical number of pumping events for each cylinder while matching the phasing of those pumping events to the motion of the individual plungers 16 associated with each cylinder 15. When this is done, the repeat pattern of pumping events per engine cycle will also include a subpattern of pumping events that repeats an integer number of times per engine cycle, with that integer number being equal to the number of engine cylinders. For instance, in the case of engine 10, the linkage 31 might be set to produce a ratio of pump shaft speed to crank shaft speed of 1.5, while utilizing a pump 30 with two pump plungers 33 each driven by a separate cam 34 that each include a diametrically opposed pair of pumping lobes 35. With this configuration, each 720° engine cycle produces 12 pumping events, or exactly two pumping events per cylinder per engine cycle.

Figure 3:
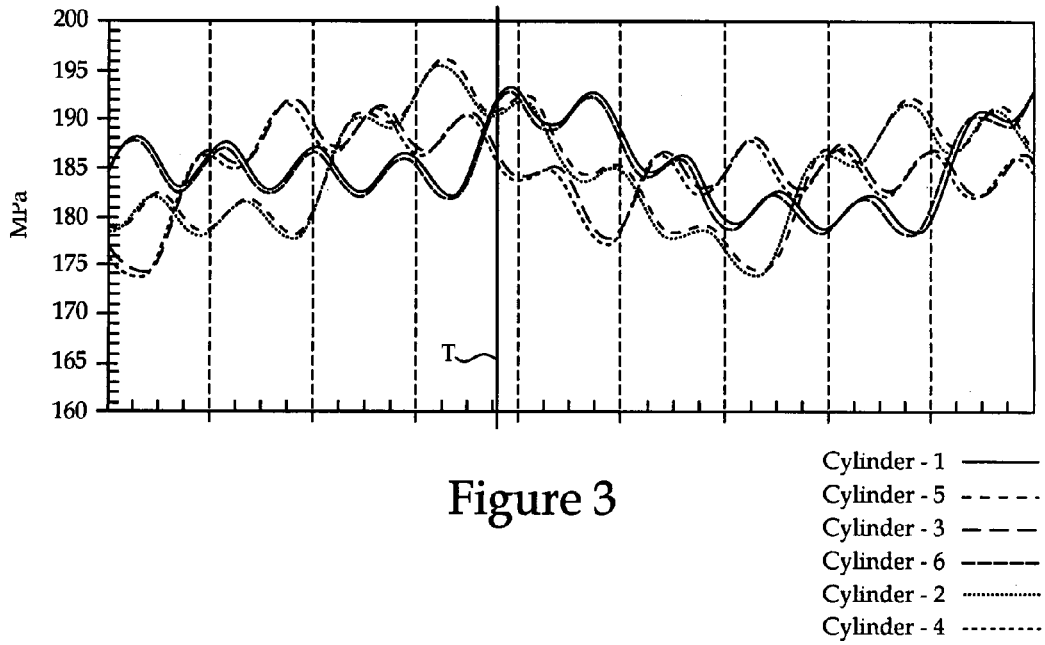
FIG. 3 is a graph of rail pressure verses engine angle superimposed by the number of cylinders for a common rail fuel system that is asynchronous with engine operation.
Figure 4:
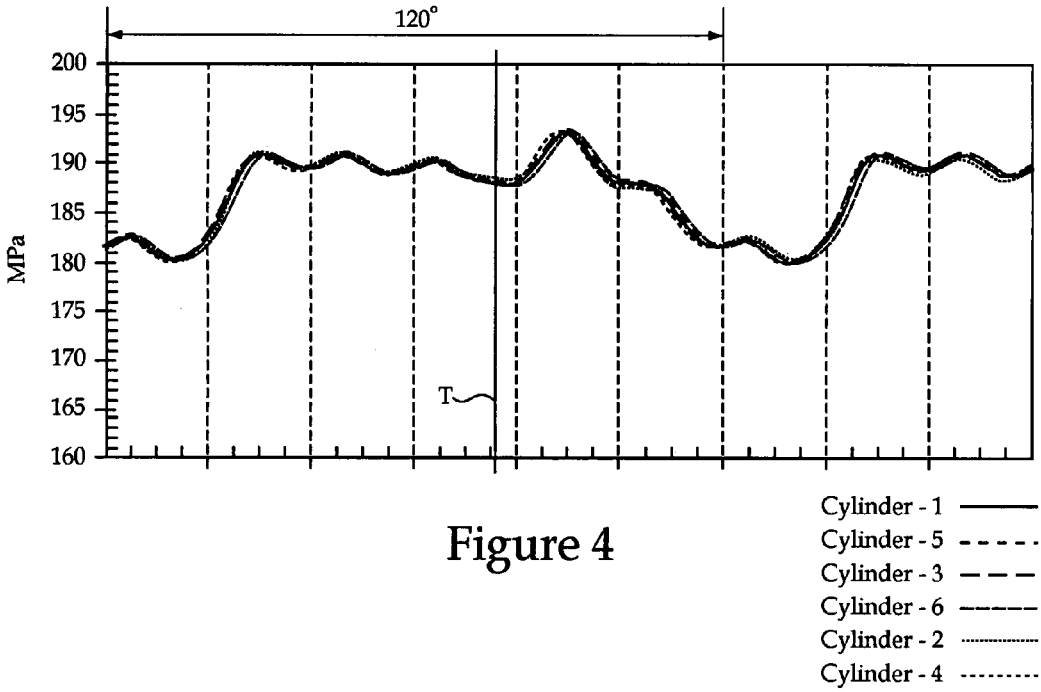
FIG. 4 is a graph similar to that of FIG. 3 except showing rail pressure curve as seen by each engine cylinder utilizing the synchronizing strategy of the present disclosure.

Referring to FIGS. 3 and 4, rail pressure for asynchronous pump/engine operation and synchronous pump/engine operation, respectively are shown. These graphs show the rail pressure as seen by each one of the six cylinders and superimposed over one another for 180° segment of crank shaft rotation corresponding to one engine piston 16 reciprocation. FIG. 3 shows that although the average rail pressure may be very tightly controlled, an injection event at time T at the same relative engine angle for each of the six cylinders results in a different initial rail pressure and a different rail pressure fluctuation over the duration of the injection event, which would occupy some segment of engine crank angle starting at time T. Thus, FIG. 3 shows that even though average rail pressure may be relatively tightly controlled and each fuel injector is given an identical control signal, one could expect the amount of fuel and the rate shape of that fuel injection event from each of the individual fuel injectors to be somewhat different. In this example, three different pairs of cylinders attempt to perform identical injection events but likely produce different injection events since each of the three pairs see a different fluctuating rail pressure during their individual injections. FIG. 4, on the other hand shows that when the pump and engine operation is made synchronous, each of the six cylinders sees an identical rail pressure fluctuation curve during its reciprocation. Furthermore, with six cylinders, each 120° segment of the rail pressure curve is a subpattern that repeats six times each engine cycle to produce an overall rail pressure curve that repeats each engine cycle due to the fact that twelve pumping events occur at different locations over the engine cycle, but at the same crank angles and at the same phasing as the motion of the individual pistons 16 for each cylinder 15. Thus, when engine 10 is operated with a synchronous pump to engine relationship as per FIG. 4, one could expect each fuel injector to respond to identical control signals with nearly identical injection events. This in turn will lead to smoother operation of engine 10 and less noise and vibrations in linkage 31.

The present disclosure recognizes that injection events and pumping events do not occur instantaneously, and instead occur over some duration of engine crank angle. The present disclosure recognizes that overall engine performance via reducing variations in rail pressure, and reducing noise and vibrations emanating from linkage 31 may be further enhanced by setting the timing of the pumping events to not overlap with expected injection events over a majority, if not all, of the engines operating range. In other words, overall performance might be enhanced by avoiding the pumping events to supply fluid to the common rail at the same time as fuel is leaving the common rail 24 for an injection event. Thus, an engine according to FIG. 3 and an engine according to the present disclosure of FIG. 4 may be apparently identical looking engines with apparently identical looking pumps but with a slightly different linkages. The engine according to FIG. 3 has a pump speed to engine speed ratio different than 1.5.

Those skilled in the art will appreciate that FIG. 4 is but one example for an engine configuration of the type shown in FIG. 1. For instance, there are numerous other linkages 31 that would produce similar results but would have a different repeating pattern of pumping events over each engine cycle. For instance, if the linkage 31 were selected to have a pump speed to engine speed ratio of 3, that would result in four pumping events per cylinder per engine cycle. Thus, the present disclosure prefers an integer number of pumping events per cylinder per engine cycle. Nevertheless, a repeating pattern over each engine cycle can still be accomplished by different linkages that result in an integer number of pumping events that repeats in a repeated cycle, each do engine cycle but not produce the standing wave type relationship exemplified by FIG. 4. For instance, if the engine 10 had a pump speed to engine speed ratio of two, a repeating pattern of 16 pumping events per engine cycle would be produced, but that would result in two and two-third pumping events per cylinder per engine cycle. However, those pumping events would be spread over the engine cycle in a manner that did not match the phasing of the motion of the engine with pistons 16.

Referring to FIG. 5, some example engine pump linkage combinations according to the present disclosure are shown. For instance, the last line of the table is comparable to the engine 10 of FIG. 1. This table also shows that toward the center of the table where another six cylinder engine could be operated in a synchronous manner similar to that of engine 10 except include a pump to engine drive ratio of one to one but utilize two pump plungers that are each driven by a three lobed cam. In such a combination, the graph of FIG. 4 would have a different shape but the result would still be a repeating pattern of pumping events per engine cycle that includes a subpattern of pumping events that repeats six times per engine cycle corresponding to the six cylinder engine. The graph of FIG. 5 in the last column describes pump strokes per combustion events. This assumes that each cylinder would be associated with one combustion event per engine cycle. Thus, the present disclosure recognizes that each combustion event may be associated with one two or more fuel injection events. In addition, each "combustion event" may actually be one combustion event in the vicinity of top dead center for the individual cylinder, or may comprise two combustion events for a given cylinder, with one combustion occurring shortly before top dead center and the second combustion event occurring some duration thereafter such as shortly after top dead center. Thus, the present disclosure is in no way limited to counting combustion in precise numbers of combustion events or injection events. Instead, the present disclosure is directed to synchronizing pump operation with engine piston motion while leveraging the full array of injection and combustion strategies known in the art to increase performance and reduce undesirable emissions, including noise and vibrations.

Figure 2:
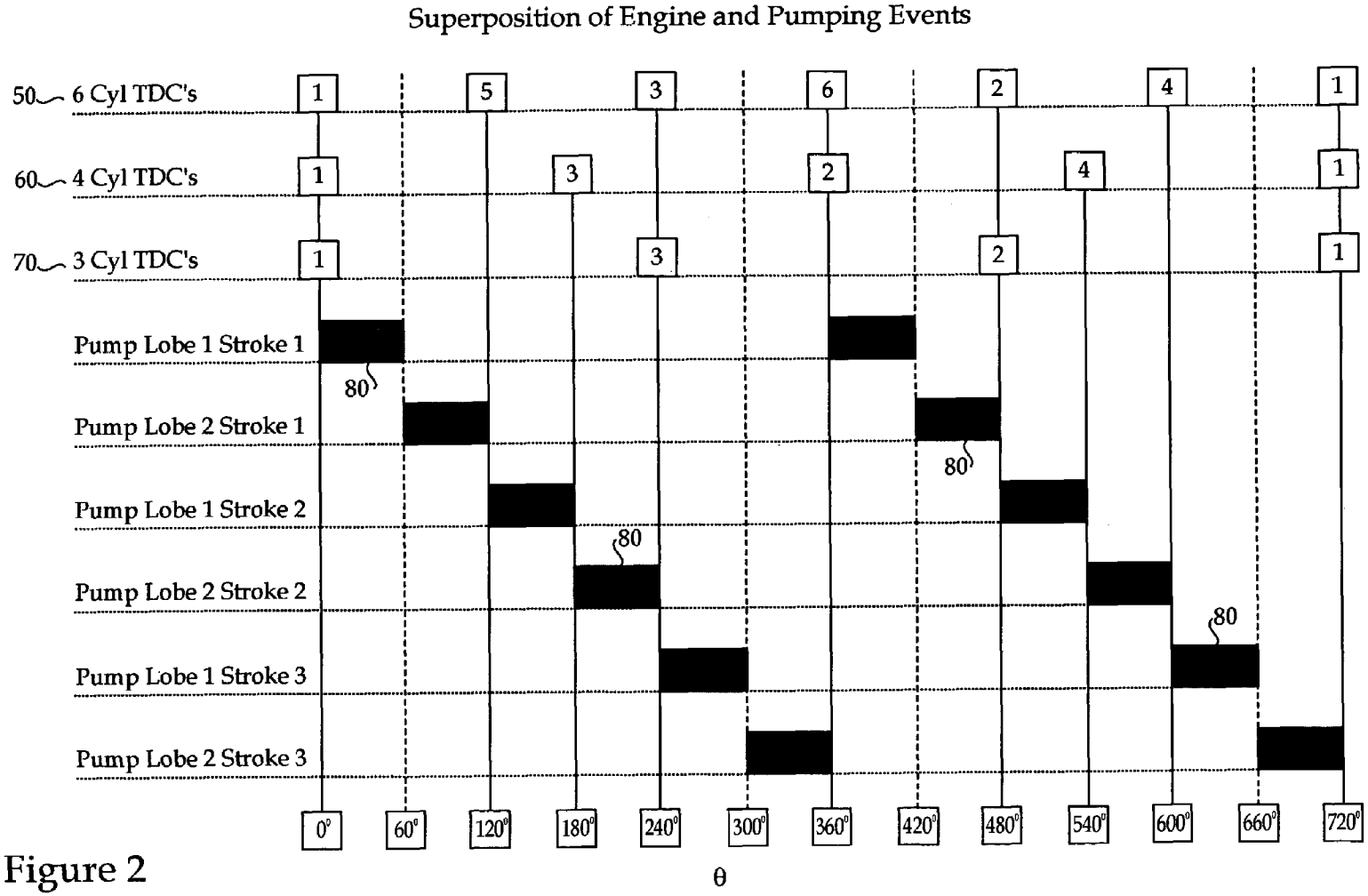
FIG. 2 is a graph of engine combustion events for six cylinder, four cylinder, and three cylinder engines utilizing a identical common rail supply pumps.

The present disclosure also contemplates leveraging the concepts of synchronizing pump in the engine operation across a family of different engines having different numbers of cylinders but utilizing the same or similar pumps driven with different linkages. Thus, the present disclosure contemplates leveraging a proven pump design across a family of engines having different numbers of cylinders that are driven with different pump to engine speed ratios to produce the synchronous relationship of the present description. For instance, FIG. 2 shows the same pump having pumping events graphed in relation to combustion events for a six cylinder engine 50, a four cylinder engine 60 and a three cylinder engine 70. In this case, the pump has two pump plungers that are each driven by separate cams with three lobes each. In this example, the pump speed to engine speed ratio is identical for the three different engines 50, 60 and 70 that still results in a synchronous relationship between the pump and engine, but with different numbers of pumping events 80 for each combustion event for the different engine. The engines 50, 60 and 70 are reflected in the table of FIG. 5 by the lines with a star adjacent the number of cylinders. As can be seen, each one of the pumps is driven at a one to one ratio with the engine to produce a synchronous relationship. However, the six cylinder engine sees two pumping events per combustion event, the four cylinder engine 60 sees three pumping events per combustion event, and the three cylinder engine 70 sees four pumping events per combustion event. Thus, by choosing a pump with an appropriate number of plungers driven with cams having an appropriate number of lobes, the same pump can be utilized across a family of apparently completely different engines, and still produce the synchronous pump engine relationship according to the present disclosure. Each of the engines 50, 60 and 70 would all have a repeating pattern of pumping events per engine cycle that also included a subpattern of pumping events per engine cycle that repeated an integer number of times each engine cycle, with that integer corresponding to the number of cylinders for the particular engine.

Figure 6:
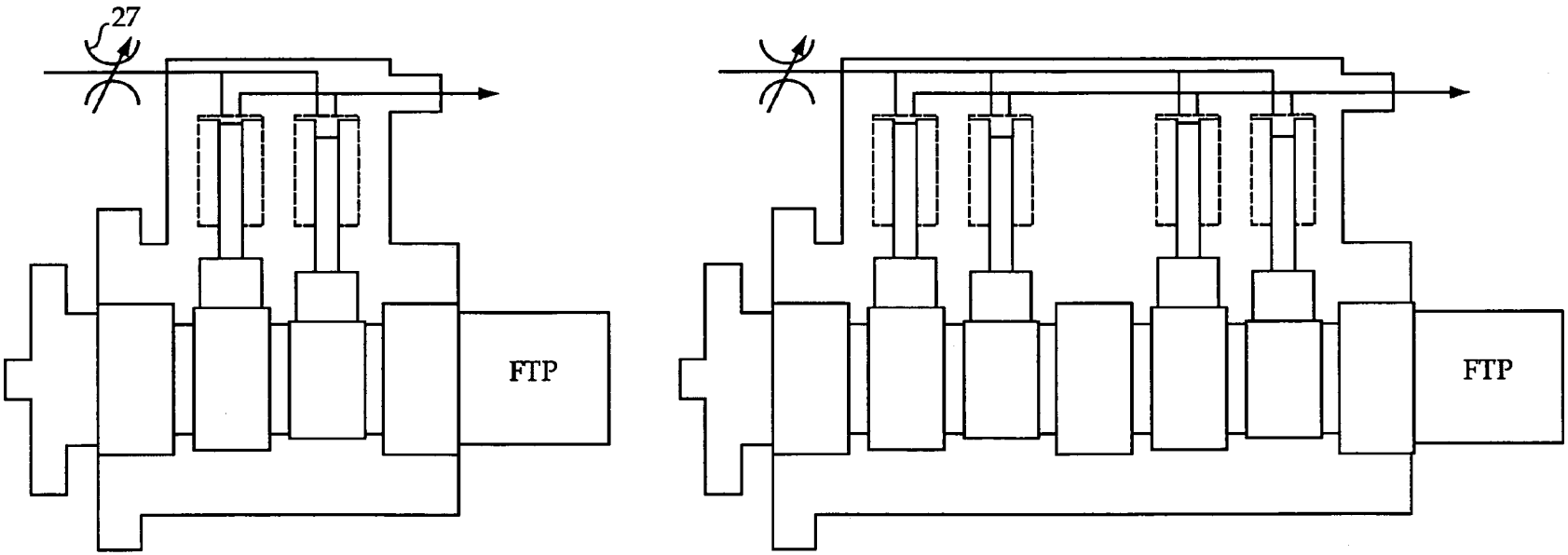
FIG. 6 is a side view of a pump family according to another aspect of the present disclosure.

Referring now in addition to FIG. 6, another pump/engine family concept according to the present disclosure is illustrated. FIG. 6 is intended to represent three different engines, which include a 6.4 liter V8, a medium range inline six cylinder engine, and a heavy duty inline six cylinder engine. The V8 and mid range inline six cylinder engines correspond to the lines in FIG. 5 with a box next to the number of cylinders. In this case, the mid range inline six cylinder engine corresponds to the engine 10 of FIG. 1. Thus, the same pump can be utilized in the V8 engine and the medium range inline six cylinder engine but merely be driven at different ratios of engine speed to pump speed to produce the synchronous relationship according to the present disclosure. The heavy duty inline six cylinder engine could utilize two pumps of the type shown in FIG. 1 or utilize a single pump that is similar except has four pump plungers each driven by two lobed cams. Those skilled in the art will appreciate that utilizing two of the pumps of the types shown in FIG. 1 or a single larger pump that is the equivalent to the pumps allows an engine manufacturer to leverage proven technology with regard to a single pump design across a whole family of engines. The heavy duty six cylinder engine utilizes four pump plungers simply because of the fact that the heavy duty engine has a much greater displacement than the medium range inline six cylinder engine associated with FIG. 1. In the case of the family of pump/engines intended to be illustrated by FIG. 6, each of the pump output may be controlled by an inlet throttle valve 27 that is electronically controlled in a conventional manner. Thus, with inlet throttling, each plunger displaces a fixed amount of fluid (fuel and vapor) with each reciprocation, but may only output an amount of fuel corresponding to the amount of fuel metered into the individual pump chamber by the throttle valve 27.

FIGS. 2 and 6 are useful in illustrating the family of engines concept according to the present disclosure. Thus, an engine manufacturer could manufacture a first group of identical x-cylinder engines that each include a common rail fuel system and a rail supply pump. The manufacturer may also manufacture a second group of identical y-cylinder engines that each include a common rail fuel system with the same rail supply pump as that used in the x-cylinder engines. Of course the number x is different than the number y. In the case of FIG. 2, x might be 6 and y might be 3. In the case of FIG. 6, x might be 6 and y might be 8. By appropriately choosing a linkage to provide a selected pump speed to engine speed ratio, all of the engines will produce a pattern of pumping events per engine cycle that repeats each engine cycle according to the present disclosure. Furthermore, if more careful selection is made in choosing the number of pump plungers and cam lobes, that repeating pattern may include a sub-pattern of pumping events that repeats an integer number of times each engine cycle, with the integer corresponding to the number of cylinders in the given engine.

The present disclosure also recognizes that a proven pump design with an appropriate number of pump pistons driven by cams with an appropriate number of lobes can be leveraged when designing a new engine. In this case, the new engine would be designed and selected to utilize a common rail fuel system with an operating pressure in excess of 160 megapascals. The common rail supply pump would be configured to be driven by the engine crank shaft of the new engine to produce a repeating pattern of pumping events in each engine cycle that repeats each engine cycle. In addition, the new design engine might accomplish this by leveraging a proven pump design adopted from a completely different engine that may include a different number of engine cylinders. Furthermore, if the pump itself has the right number of pump plungers and cam lobes per plunger, the synchronicity of the present disclosure can be further leveraged by having a sub-pattern of pumping events that repeats an integer number of times each engine cycle, with that integer corresponding to the number of cylinders for the given engine. Furthermore, the pumping event can be in phase with the motion of the engine pistons to result in an overall improvement in performance and a reduction in vibrations and noise, especially those associated with the pump drive linkage.

INDUSTRIAL APPLICABILITY

The present disclosure is applicable to any engine that utilizes a common rail fuel system that includes a common rail supply pump driven directly by the engine. The present disclosure is also applicable to families of engines that utilize the same pump in their respective common rail systems, but the engines themselves are very different in their respective number of cylinders. Furthermore, the present disclosure is applicable to the design of new engines that may or may not leverage proven technology associated with a pump utilized in a common rail fuel system of a previous engine that may or may not have the same number of engine cylinders. Engine systems that utilize a common rail system with operating pressures in excess of 160 megapascals will typically be differentiated from their lower pressure cousins by some structural features such as thicker wall sections and other structural features for containing the higher pressure. Likewise a rail pressure relief valve will be set to a higher pressure than the pressure relief valve associated with a lower pressure common rail system. In addition, the injector nozzle might be configured to provide better combustion at the expected higher rail pressure, which may correspond to smaller orifices at higher pressures. Heat rejection to fuel may become a bigger issue in engines according to the present disclosure, hence it might be more common to find fuel coolers on engines according to the present disclosure that operate in excess of 160 megapascals.

Advantages of the present disclosure are manyfold depending upon how the concepts are used such as in designing a new engine, using a single pump across a family of different engines or simply adjusting a given engine to operate in the synchronous pump to engine relationship with the present disclosure. In any event, the present disclosure provides the advantage of matching the sequence of high pressure common rail pumping events with a sequence of engine injection and combustion events to minimize fuel pump induced gear train dynamics, noise, vibration and harshness levels, and variances in cylinder to cylinder fueling levels and rate shapes through improved repeatability of pressure apparent at the injector nozzle at the time of start of injection and thereafter. These advantages become readily apparent as shown in FIGS. 3 and 4 when compared to apparently similar fuel system designs where the pumping and combustion events are asynchronous. The present disclosure is further leveraged by selecting pump drive ratios and/or cam shaft profiles that result in integer multiples of pump plunger operating frequency as compared to engine combustion frequency. This aspect of the present disclosure is reflected by not only having a repeating pattern of pumping events per engine cycle, but that repeating pattern includes a sub-pattern of pumping events that repeats an integer number of times each engine cycle, with that integer corresponding to the number of cylinders for the given engine. Furthermore, by selecting an appropriate phasing in the linkage between the pump and the engine crank shaft, a better placement of pumping events relative to combustion events can be selected based upon what features are most important for a given engine configuration and application. For instance, it might be desirable to select that linkage so that the pumping events and injection events do not overlap in time over the majority of the engines operating range. The strategy of the present disclosure allows for a small number of pump configurations to provide effective coverage and synchronous operation with many different engine configurations.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A method of operating an engine, comprising the steps of:

pressurizing fuel in a common rail to a pressure in excess of about one hundred sixty megapascals with at least one pump;

injecting fuel from the common rail via respective fuel injectors into each of a plurality of engine cylinders;

synchronizing action of the at least one pump with the engine such that a pattern of pumping events per engine cycle repeats during each engine cycle, and wherein the synchronization step includes setting a ratio of a number of pumping events per engine cycle to a number of engine cylinders to be an integer; and wherein the pattern of pumping events per engine cycle includes a sub pattern of pumping events that repeats an integer number of times per engine cycle, and the integer number equals a number of engine cylinders.

2. The method of claim 1 wherein the integer is one or two; and the number of engine cylinders is one of eight and six, respectively.

3. The method of claim 1 wherein the synchronizing step includes setting a pump speed to engine speed ratio to be one and a half to one.

4. The method of claim 1 wherein the synchronizing step includes setting a pump speed to engine speed ratio to be one to one.

5. The method of claim 1 wherein the synchronizing step includes performing an integer number of pumping events per engine cycle with each pump piston.

6. The method of claim 1 wherein the sub pattern of pumping events are in phase with a plunger motion of each of the engine cylinders.

7. An engine comprising:

an engine housing having a plurality of cylinders disposed therein;

a crank shaft rotationally supported in the engine housing;

a common rail fuel system attached to the engine housing, and configured to contain fuel at a fuel pressure in excess of about one hundred and sixty megapascals;

the common rail fuel system including at least one pump with an outlet fluidly connected to a common rail, and a plurality of fuel injectors with inlets fluidly connected to the common rail, and each of the plurality of fuel injectors being positioned for direct injection into one of the plurality of cylinders, and the at least one pump includes at least one pump plunger and a cam with at least one lobe associated with each pump plunger;

a linkage operably coupling the at least one pump to the crank shaft;

wherein the linkage, the at least one pump plunger and at least one lobe are configured to produce a pattern of pumping events per engine cycle that repeats each engine cycle; and wherein the pattern of pumping events per engine cycle includes a sub pattern of pumping events that repeats an integer number of times per engine cycle, and the integer number equals a number of engine cylinders.

8. The engine of claim 7 wherein the sub pattern of pumping events are in phase with a piston motion of each of the engine cylinders.

9. The engine of claim 8 wherein the engine is one of a six cylinder engine and an eight cylinder engine.

10. The engine of claim 7 wherein the at least one pump plunger is two; and the at least one lobe is two lobes.

11. The engine of claim 7 wherein the at least one pump plunger is four pump pistons; and the at least one lobe is two lobes.

12. A family of engines comprising:

a first group of identical X cylinder engines that each include a first common rail fuel system with a rail supply pump;

a second group of identical Y cylinder engines that each include a second common rail fuel system with the rail supply pump;

wherein X is a different number than Y;

wherein the rail supply pump is configured in both the X cylinder engines and the Y cylinder engines to produce a pattern of pumping events per engine cycle that repeats each engine cycle; and wherein the pattern of pumping events per engine cycle includes a sub pattern of pumping events that repeats an integer number of times per engine cycle, and the integer number equals a number of engine cylinders.

13. The family of engines of claim 12 wherein X is six and Y is eight; and the rail supply pump has exactly two pump plungers that are each driven to reciprocate by a two lobed cam.

14. A method of designing a new engine, comprising the steps of:

selecting a common rail fuel system with an operating pressure in excess of one hundred and sixty megapascals;

configuring a common rail supply pump of the common rail fuel system to be driven by a crank shaft of the new engine to produce a repeating pattern of pumping events in each engine cycle that repeats each engine cycle; and wherein the configuring step includes configuring the common rail supply pump to produce a sub-pattern of pumping events that repeats an integer number of times per engine cycle, and the integer number equals a number of engine cylinders.

15. The method of claim 14 wherein the sub pattern of pumping events are in phase with a piston motion of each of the engine cylinders.

16. The method of claim 1 wherein the synchronization step includes setting a ratio of a number of pumping events per engine cycle to a number of engine cylinders to be an integer greater than one.

* * * * *